US006887055B2

(12) United States Patent
Morselli

(10) Patent No.: US 6,887,055 B2
(45) Date of Patent: May 3, 2005

(54) POSITIVE-DISPLACEMENT ROTARY PUMP

(76) Inventor: Mario Antonio Morselli, Via del Carmine, 23, 41100 Modena (IT)

( * ) Notice: Subject to any disclaimer, the term of this patent is extended or adjusted under 35 U.S.C. 154(b) by 0 days.

(21) Appl. No.: 10/280,350

(22) Filed: Oct. 25, 2002

(65) Prior Publication Data

US 2004/0081570 A1 Apr. 29, 2004

(51) Int. Cl.[7] ..... F03C 02/00
(52) U.S. Cl. ..... 418/132; 418/201.1; 418/203
(58) Field of Search ..... 418/132, 201.1, 418/203

(56) References Cited

U.S. PATENT DOCUMENTS

| | | | | |
|---|---|---|---|---|
| 2,808,785 A | * | 10/1957 | Hilton | 418/132 |
| 2,816,510 A | * | 12/1957 | Jarvis | 418/132 |
| 3,057,302 A | * | 10/1962 | Lockett | 418/132 |
| 3,104,616 A | * | 9/1963 | Peet | 418/132 |
| 3,142,260 A | * | 7/1964 | Oliver | 418/132 |
| 3,209,611 A | | 10/1965 | Iyoi | |
| 3,937,604 A | * | 2/1976 | Taylor | 418/132 |
| 3,945,779 A | * | 3/1976 | Vlemmings et al. | 418/206.7 |
| 4,794,540 A | | 12/1988 | Gutman et al. | |
| 5,028,855 A | | 7/1991 | Distler et al. | |
| 5,417,556 A | * | 5/1995 | Waddleton | 418/132 |

FOREIGN PATENT DOCUMENTS

| | | | |
|---|---|---|---|
| DE | 3605246 A1 * | 8/1987 | F04C/2/14 |
| DE | 93 15 768.1 | 4/1994 | |
| EP | 1 132 618 | 9/2001 | |
| JP | 30-7809 | 10/1955 | |
| WO | WO 96/01950 | 1/1996 | |
| WO | WO 01/44693 | 6/2001 | |

OTHER PUBLICATIONS

"Sulla Portata delle pompe ad ingranaggi" (About Rate Flow of Gear Pumps) , Dr. Ing. Claudio Bonacini, *L'Ingegnere*, 1961, No. 9, pp. 1–8, and English translation of summary therof.

* cited by examiner

*Primary Examiner*—Theresa Trieu
(74) *Attorney, Agent, or Firm*—Flynn, Thiel, Boutell & Tanis, P.C.

(57) ABSTRACT

A positive-displacement rotary pump comprising a pair of meshing gears (13, 14) or rotors, consisting of a driving gear and a driven gear, contained in a shell (10) having an output opening and an intake opening for a fluid. The gears (13, 14) include shafts (23, 24) which are supported by bushings (15*a*, 15*b*) having two faces (17*a*, 17*b*) which are subjected, in use, to pressures which bring about an axial load on the bushing itself, wherein the resultant of the axial loads (S', S") on the two bushings has a predetermined direction so as to move the bushings (15*a*, 15*b*) and the gears (13, 14) as a whole into close abutment with a predetermined reference plane (VI—VI).

9 Claims, 4 Drawing Sheets

FIG. 1 (PRIOR ART)
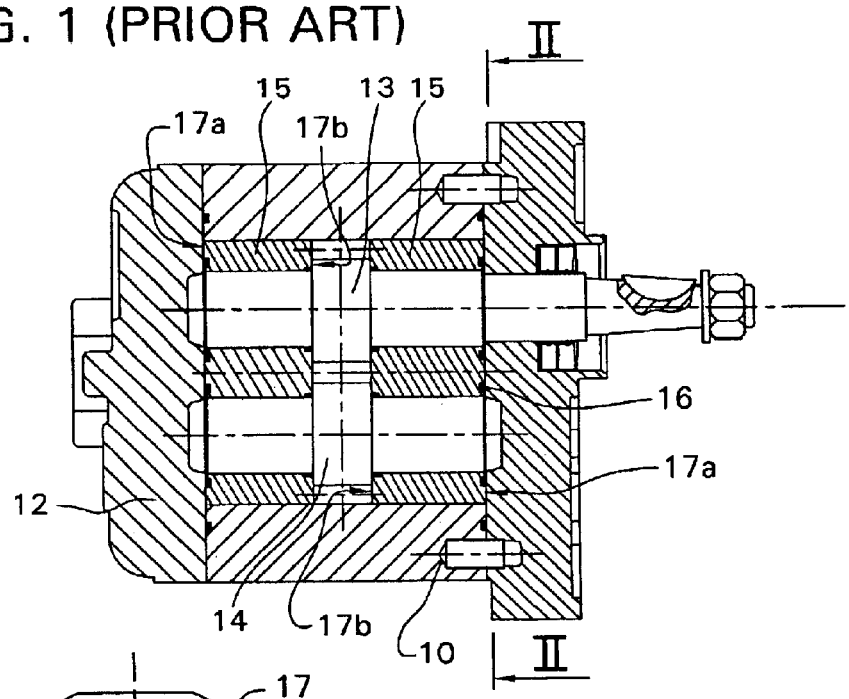
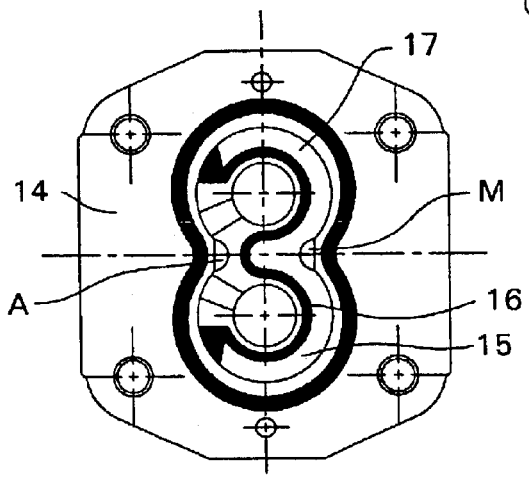
FIG.2 (PRIOR ART)
FIG. 4
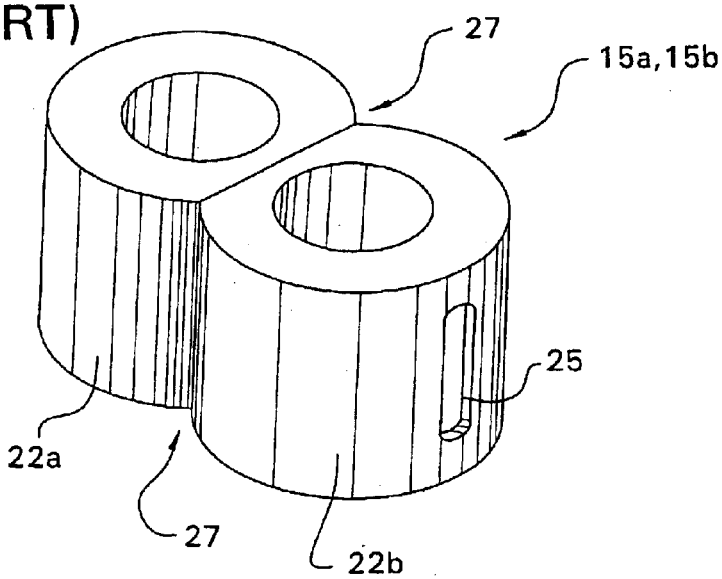

POSITIVE-DISPLACEMENT ROTARY PUMP

FIELD OF THE INVENTION

The present invention relates to positive-displacement rotary pumps and specifically gear pumps.

BACKGROUND OF THE INVENTION

Gear pumps generally comprise two gears, one of which, known as the driving gear, is connected to a drive shaft and causes the other wheel, known as the driven gear, to rotate. The pumps of this type for high pressures are generally produced with a so-called "balanced" or "equilibrated" configuration, in which the two opposing faces of the bushings for supporting the gears are subjected to pressures over areas which, although they are large in absolute terms, are not very different from each other in order to generate a moderate differential force which tends to keep each bushing in contact with the gears.

FIGS. 1 and 2 illustrate an example of a gear pump of known type. In particular, FIG. 1 is a longitudinal section along a plane which extends through the axes of rotation of the two gears, and FIG. 2 is a section taken on line II—II in FIG. 1. The driving gear 13 and the driven gear 14, whose shafts are each supported by two bushings 15, are housed inside a shell 10 which is closed by a front cover 11 and a rear cover 12. Omega-shaped (Ω) seals 16 which separate the intake zone (A), at lower pressure, from the output zone (M), at higher pressure, are housed on the outer face 17*a* of the bushings 15. During use, the bushings 15 are subjected to a pressure both on the outer faces 17*a* thereof and on the inner faces 17*b* thereof. The omega-like configuration of the seals 16 is such that the portion of outer face 17*a* of each bushing 15 on which the output pressure, which is greater than the intake pressure, acts is greater than the portion of inner face 17*b* of the bushing which is subjected to the same output pressure. Since the area on which the output pressure acts in the region of the inner face 17*b* of each bushing cannot be determined with accuracy, the optimum configuration of the omega-like seal 16 is usually identified by trial and error.

Owing to the difference between the pressures which act on the two faces, the outer face 17*a* and inner face 17*b*, the bushings 15 are urged with a force which is moderate, and controlled, against the gears 13 and 14 so as to minimize the leakages over the faces of the gears themselves as a result of the difference in pressure between the intake and output. In the prior art, therefore, the two bushings are floating in an axial sense.

Obtaining good leak-tightness between the intake and output is one of the principal objectives in the production of gear pumps. In fact, the efficiency of pumps of this type declines rapidly if the leak-tightness is not total. Another problem which the manufacturers of pumps have to deal with is the noise of the pumps themselves, owing to irregular phenomena, or "ripples", in the transfer of the fluid. A study of the above-mentioned problems linked to the design of gear pumps is set out in "C. Bonacini, Sulla portata delle pompe ad ingranaggi (On the efficiency of gear pumps), L'ingegnere, 1961 n. 9".

The above-mentioned solutions of the prior art have the common problem consisting in the noise of operation caused by the instantaneous oscillations of the output over time, better known as ripple noise. The above-mentioned oscillations generate a pulsating wave which, by way of the fluid, is transmitted to the surroundings and, in particular, to the walls of the pump, to the pipes and to the output ducts. The noise produced can reach levels which are also unpredictable where the above-mentioned members begin to resonate with the frequency of oscillation or ripple.

In addition to this, the rotation of the gears causes a periodic variation in the area of the inner face 17*b* of the bushings 15 that is exposed to the output pressure. This variation determines oscillations in the axial loads on the bushings, which contributes to an increase in the noise of the pump, besides reducing the total efficiency thereof. This oscillation of the axial loads, which is normally of small magnitude in gear pumps having straight teeth, becomes significantly greater in gear pumps having helical teeth, in which the meshing between the gears is the cause of both mechanical and hydraulic axial loads such that the balance and the taking-up of clearances on the bushings illustrated in FIGS. 1 and 2 is not completely satisfactory, since the hydraulic axial loads have perceptible pulses.

SUMMARY OF THE INVENTION

The object of the present invention is to provide a positive-displacement rotary pump which overcomes the disadvantages of the prior art and, in particular, which substantially reduces the noise without resulting in a substantial increase in the cost and complexity of production in comparison with pumps of known type. A further object of the invention is to provide a pump which has good leak-tightness characteristics between the intake and output, which is simple and economic to produce and maintain and which has good reliability over time.

In order to achieve the above-mentioned objects, the subject-matter of the invention is a positive-displacement pump which comprises the features indicated in the claims appended to the present description.

One advantage of the present invention consists in that the axial position of the rotors is unambiguously defined even in the event that they are subjected to axial loads or pressures owing to mechanical contact with the shell or portions thereof. In fact, it is known that, in the running-in stages of pumps of known type, it is accepted and desirable for there to be contact of portions of the rotors with the shell so that the rotors remove an extremely small layer of material until an individual seat has been "scooped out", in such a manner that, when the pump is used after the running-in operation, the clearance between the teeth of the rotors and the shell has minimal dimensions. This slight interference between the helical teeth of the rotors and the shell of the pump produces additional axial loads on the rotors, which mainly have an unknown value. The present invention, by providing a fixed plane of reference, also ensures the correct positioning of the rotors in the initial running-in stage of the pump, and even in the event of interference between the rotors and the shell, when unknown axial forces resulting from the above-mentioned mechanical contact are added to the axial forces expected in normal operation of the pump.

BRIEF DESCRIPTION OF THE DRAWING

Other characteristics and advantages of the invention will become clear from the following detailed description which is given with reference to the appended drawings which are provided purely by way of non-limiting example and in which:

FIGS. 1 and 2 illustrate, as described above, a gear pump of known type, FIG. 4 is a perspective view of a bushing set of the pump in FIG. 3.

DETAILED DESCRIPTION

Figure 3:
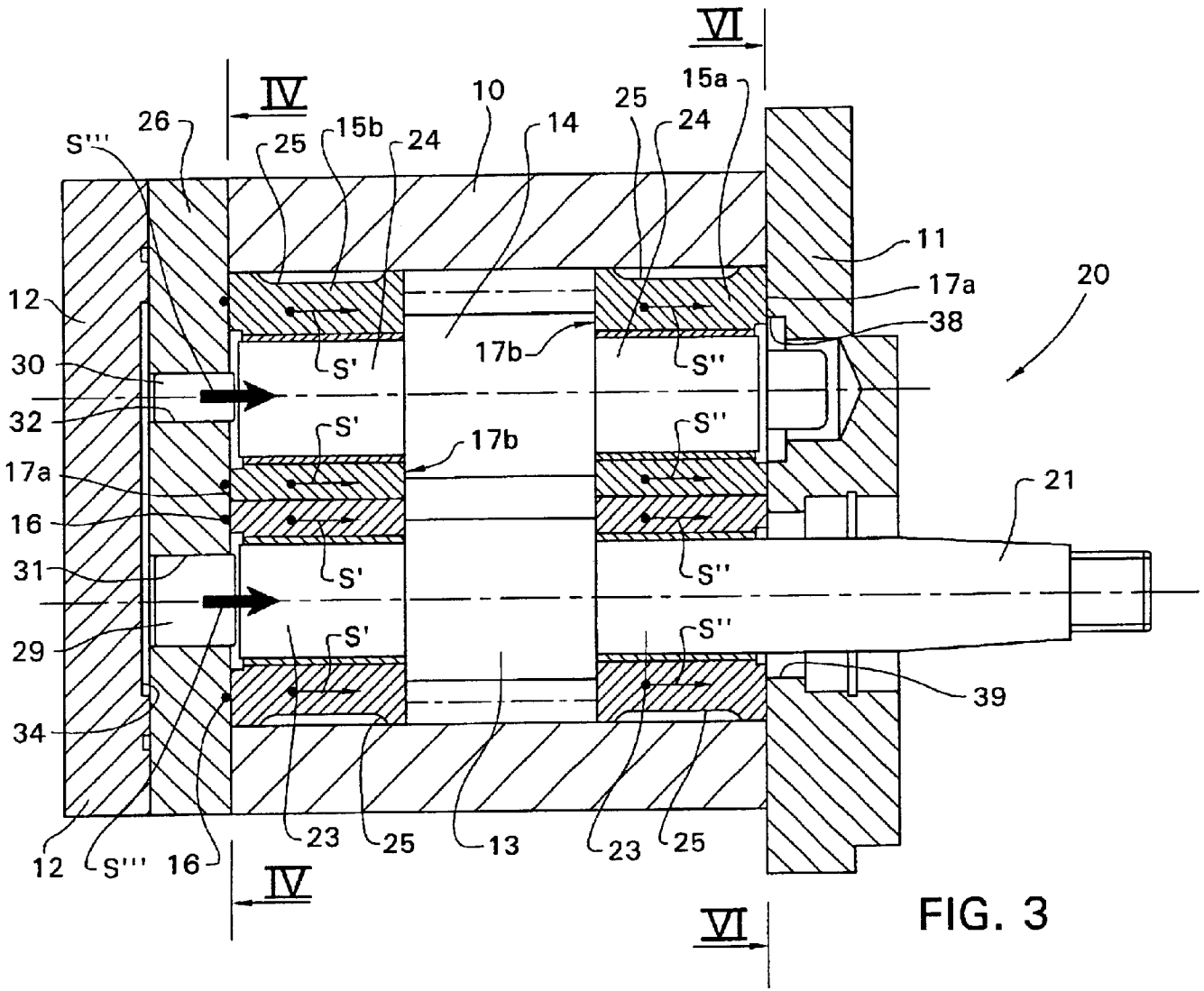
FIG. 3 is a longitudinal section of a gear pump according to the present invention, substantially similar to FIG. 1, in which identical reference numerals identify corresponding elements.

Now with reference to FIG. 3, a gear pump 20 comprises, as already described above with reference to the known pump in FIGS. 1 and 2, a shell 10 having an output opening and an intake opening for a fluid, inside which are housed the driving gear 13 and the driven gear 14. In the example in the Figure, the gears 13 and 14 are of the cylindrical type having helical teeth, but naturally the invention can also be used with different gears, for example, a pair of straight spur gears, similar to that in the prior art illustrated in FIG. 1.

The shell 10 is closed at the two ends by the front cover 11 and the rear cover 12. The end 21 of the shaft 23 of the driving gear 13 protrudes from the front cover 11. For ease of illustration, the seals between the shaft 23 and the front cover 11 have been omitted in FIG. 3. Inside the shell 10, the shafts 23 and 24 of the gears 13 and 14, respectively, are supported by two bushing sets, a front bushing set 15*a* and rear bushing set 15*b*. Each of the bushing sets 15*a* and 15*b* can be produced in one piece, as in the case of the known pump in FIG. 1, or preferably in two separate pieces 22*a*, 22*b*, as illustrated in detail in FIG. 4. This latter preferred solution is more economical and precise from the point of view of production since it is easier to obtain very high levels of working precision without any necessity for resorting to special machine tools. Furthermore, such a configuration of bushing sets minimizes the axial output passages for fluid, in the region of the central zones 27 of the bushing sets 15*a*, 15*b* which correspond to the meshing zone of the gears 13, 14. Longitudinal channels 25 are preferably, but not in a limiting manner, provided on the two flanks of each bushing set 15*a*, 15*b* and promote the distribution of the output pressure over the flanks of the bushing sets so as to keep the two separate pieces 22*a*, 22*b* close together.

Figure 7:
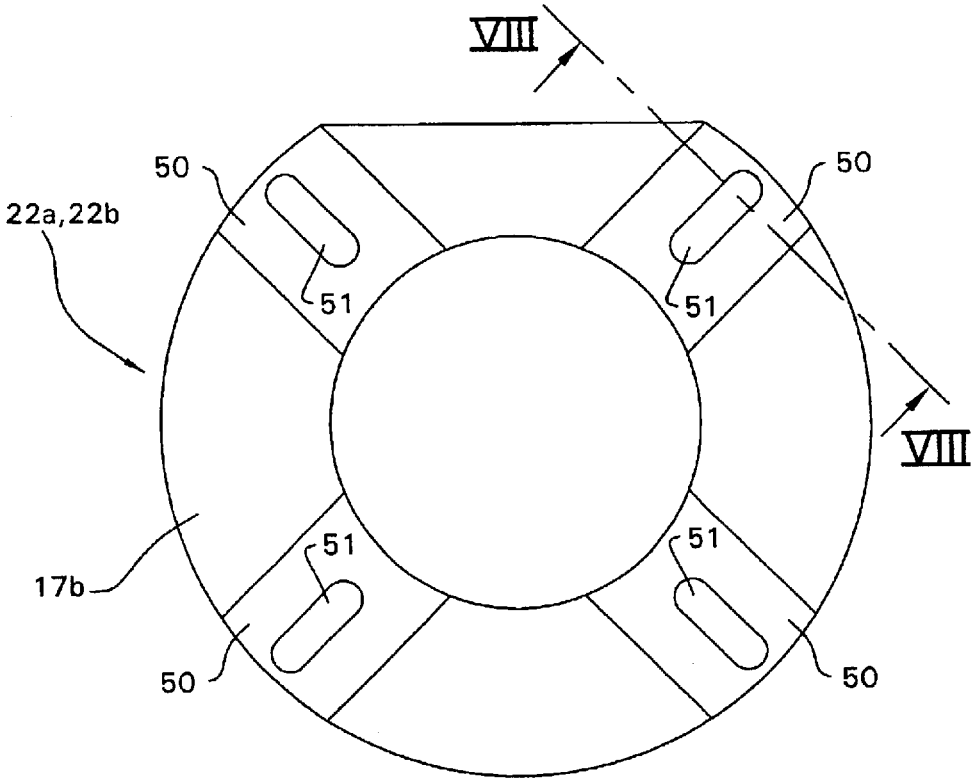
FIG. 7 is a top view of a variant of one of the two components of a bushing set, configured to promote the hydrodynamic lubrication thereof.
Figure 8:
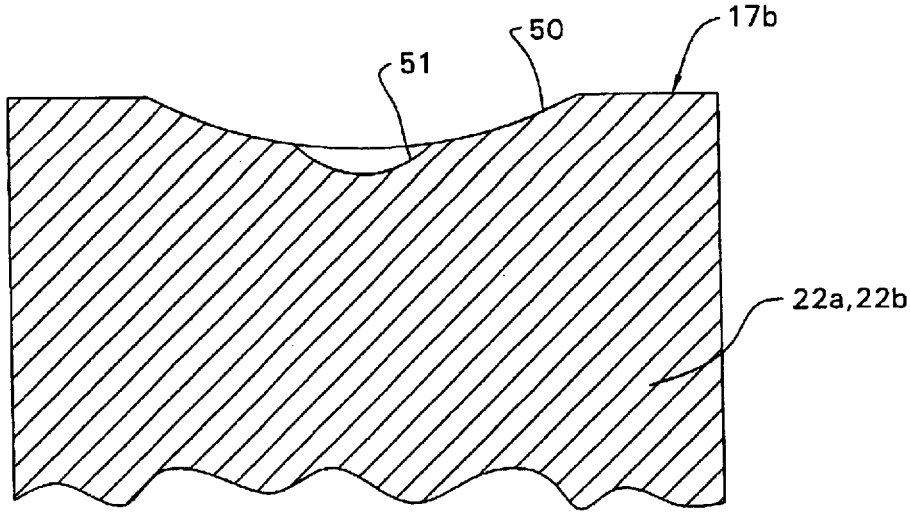
FIG. 8 is a cross-section, drawn to an enlarged scale, taken on line VII—VII in FIG. 7, in which the depth of the depressions or channels of the bushing has been greatly increased for clarity of description.

The bushing sets 15*a*, 15*b*, both in the one-piece version and in the version produced by means of separate pieces 22*a*, 22*b*, can preferably have passages having variable width in order to allow the hydrodynamic lubrication thereof. One embodiment is illustrated in FIGS. 7 and 8, wherein the face 17*b* of each piece 22*a*, 22*b* of one or both of the bushing sets 15*a*, 15*b* has depressions or channels 50 which extend in a radial direction and whose profile-section is slightly concave in a direction orthogonal to the radius of the piece 22*a*, 22*b*. A slightly deeper slot or channel 51 is preferably provided in a substantially central position in respect of each depression or channel 50 for better distribution of the lubricating fluid. The behaviour in use of a pump with bushing sets configured in this manner allows the performance thereof to be further improved, especially during use at high operating pressures.

At the end adjacent the rear cover 12, the shafts 23, 24 react against a pair of check pins or balancing pistons 29, 30 which are mounted for axial sliding in a close-fitting manner in respective axial bores 31, 32 which are provided in an intermediate plate 26. The ends of the check pins 29, 30 that are remote from the shafts 23, 24 are directed towards a common chamber 34 which is provided in the rear cover 12 and which, in use, is preferably in communication with the output of the rotary pump. In this manner, the pressurized fluid which will occupy the chamber 34 acts on the check pins 29, 30 so as to oppose the axial load produced by the gears 13, 14.

Figure 5:
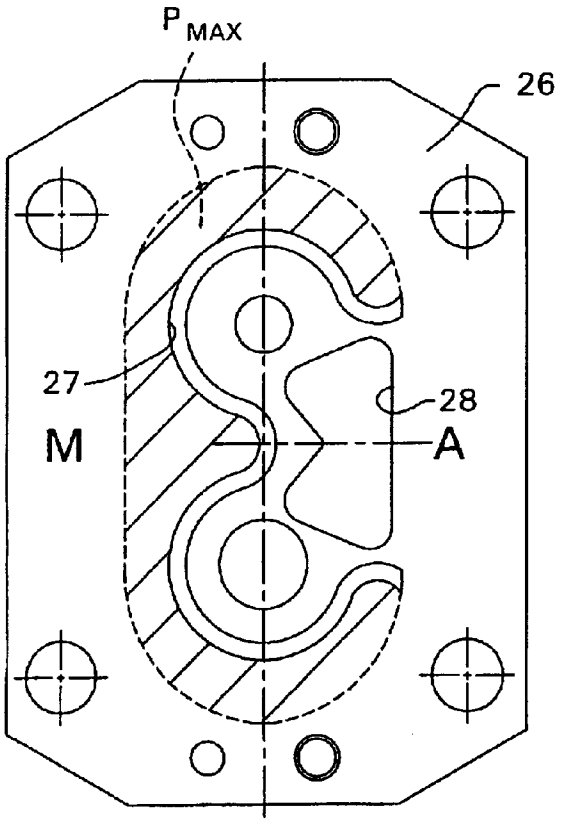
FIG. 5 is a plan view of an intermediate plate of the pump, taken in the plane of the line V—V in FIG. 3.

As is visible in FIG. 5, a groove 27 for accommodating a seal 16 which is, for example, substantially configured in an "omega"-like manner, is provided in the face of the intermediate plate 26. An opening 28 is provided at the side of the plate that, when the pump is in use, communicates with the intake A. The configuration of the intermediate plate 26, which is similar to that of the lower cover of the pumps of the prior art in FIGS. 1 and 2, allows, during use of the pump, a distribution of output pressure M to be obtained over the outer face 17*a* of the rear bushing 15*b* which substantially affects the area $P_{MAX}$ indicated with hatching in FIG. 5. This area, as is known, is greater than the area of the inner face 17*b* of the rear bushing 15*b* which is subjected to the output pressure, as long as the force differential owing to the pressure provides for the production of an axial load on the rear bushing 15*b* directed towards the gears 13, 14, as indicated by arrow S' in FIG. 3.

Figure 6:
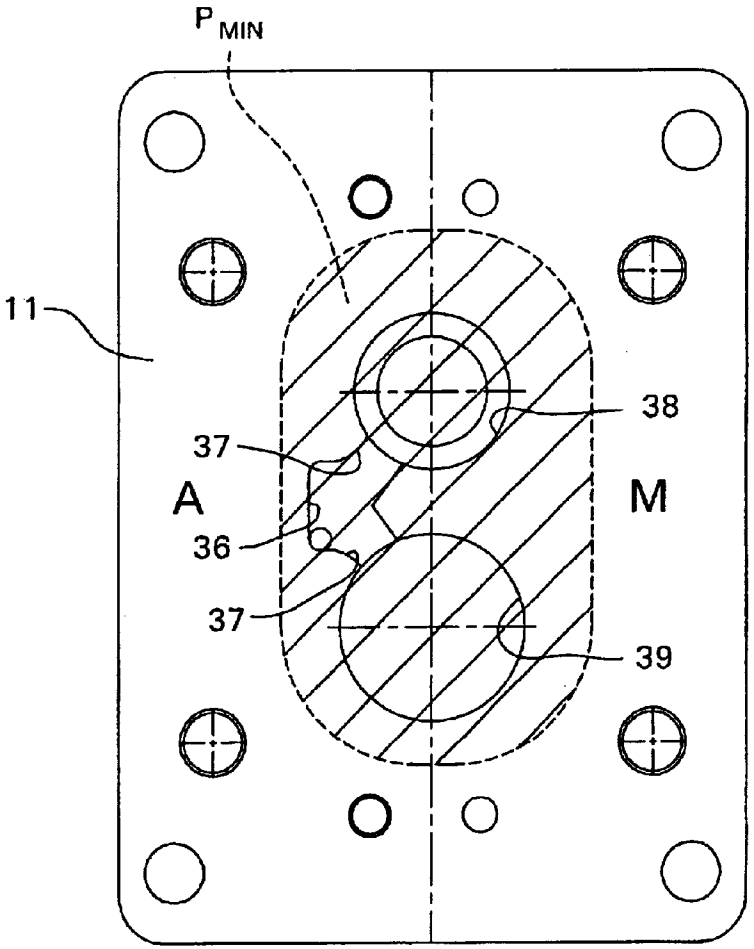
FIG. 6 is a plan view of the front cover of the pump, taken in the plane of the line VI—VI in FIG. 3.

With reference now to FIG. 6, the inner face of the front cover 11, unlike the pumps of known type, does not have the omega-like seal, and is instead provided with a large opening 36 which communicates with the intake A of the pump. Two limbs 37 which communicate with the openings 38, 39 for housing the shafts 23, 24 of the gears 13, 14 extend from the opening 36. This configuration of the face of the front cover 11 ensures that the outer face 17*a* of the front bushing 15*a* is subjected only to the intake pressure, which affects, by way of indication, the hatched area, which is denoted $P_{MIN}$ in FIG. 6. Since, however, a portion of the inner face 17*b* of the same front bushing 15*a* is also subjected to the output pressure, the pressure differential acts on the front bushing 15*a* in a manner counter to that seen previously for the rear bushing 15*b*, as long as during use of the pump, the front bushing 15*a*, and in particular the two pieces 22*a*, 22*b* thereof, are urged firmly against the face of the front cover 11, as indicated by arrow S" in FIG. 3.

At all times during use of the pump, the pressure applied to the shafts 23, 24 by the check pins 29, 30 is such that the gears 13, 14 are in turn thrust axially onto the front bushing set 15*a*, as indicated by arrow S'". Consequently, the axial forces S', S" and S'" which are produced during the operation of the pump all act in the same direction and contribute to keeping the gears 13, 14 and the front bushing set 15*a* and rear bushing set 15*b* as a whole in abutment with the reference plane, indicated by line VI—VI in FIG. 3, which is constituted by the face of the front cover 11 that is directed towards the inside of the shell 10.

In this manner, there is obtained a taking-up of the axial clearances which is complete and constantly defined in spite of the oscillation of the axial forces produced during the rotation and the meshing of the gears 13, 14.

As is visible in FIG. 3, the check pins 29, 30 have different diameters in order to apply different axial loads to the two gears 13, 14. This is because, in the example of the Figure, the driving gear 13 and driven gear 14 are of a helical type and therefore, during operation, produce per se axial loads whose direction is counter to and in accordance with the direction of the axial load applied by the check pins 29, 30.

Naturally, in the case of gears having straight teeth which do not produce per se axial loads, the check pins 29, 30 can have substantially corresponding diameters so as to apply an axial load of equal intensity to both of the gears.

Naturally, the principle of the invention remaining the same, the forms of embodiment and details of construction may be varied widely with respect to those described and illustrated, without thereby departing from the scope of the present invention.

What is claimed is:

1. Positive-displacement rotary pump comprising a pair of meshing gears defining a driving gear and a driven gear, which are contained in a shell having an output opening and an intake opening for a fluid, the gears having shafts which are supported by bushings having two faces subjected, to pressures which bring about an axial load (S', S") on the bushing itself, the resultant of the axial loads (S', S") on the two bushings having a predetermined direction so as to move the bushings and the gears as a whole into close abutment with a predetermined reference plane, said gears having meshing helical teeth, and a system for compensating for the loads including axial load means which act on the same end of each shaft of the gears, the axial load means causing, an axial load (S"') on the gears which prevails over the axial forces produced by the meshing and having the same direction as the resultant of the axial loads (S', S") on the bushings.

2. Positive-displacement pump according to claim 1, wherein the axial load means comprise check pins or balancing pistons which are mounted for axial sliding in a tight manner in respective bores which are provided in a plate fixed to one of the two covers of the shell of the pump.

3. Positive-displacement pump according to claim 2, wherein the check pins press, at one end, on the ends of the shafts of the gears and, at the other end, are directed towards a common chamber which is provided in the cover of the shell, the common chamber being in communication with the output opening of the rotary pump.

4. Positive-displacement pump according to claim 2, wherein the check pins have different diameters.

5. Positive-displacement pump according to claim 1, wherein the axial load means have different dimensions so as to apply different axial loads (S"') to each of the gears.

6. Positive-displacement rotary pump comprising a pair of meshing gears defining a driving gear and a driven gear, which are contained in a shell having an output opening and an intake opening for a fluid, the gears having shafts which are supported by bushings having two faces subjected, to pressures which bring about an axial load (S', S") on the bushing itself, wherein the resultant of the axial loads (S', S") on the two bushings has a predetermined direction so as to move the bushings and the gears as a whole into close abutment with a predetermined reference plane, wherein at least one bushing comprises at least two separate pieces, each of which supports in rotation an end of one of the two shafts of the gears, and wherein at least one longitudinal channel is provided on the flanks of each separate piece of the at least one bushing and promotes the distribution of the output pressure over the flanks of the bushing, so as to keep the two separate pieces close together.

7. Positive-displacement rotary pump comprising a pair of meshing gears defining a driving gear and a driven gear, which are contained in a shell having an output opening and an intake opening for a fluid, the gears having shafts which are supported by bushings having two faces subjected, to pressures which bring about an axial load (S', S") on the bushing itself, wherein the resultant of the axial loads (S', S") on the two bushings has a predetermined direction so as to move the bushings and the gears as a whole into close abutment with a predetermined reference plane, the outer face of one of the two bushings is directed towards the reference plane and is affected only by the intake pressure ($P_{MIN}$), a portion ($P_{MAX}$) of the outer face of the other one of the two bushings is affected by the output pressure (M), the portion ($P_{MAX}$) being separated from the remaining portion of the outer face, which is affected by the intake pressure (A), by a separating seal which is connected to a plate directed towards the outer face of said other bushing, in such a manner that the resultant of the pressures on the outer face of said other bushing is constantly greater than the resultant of the pressures acting on the inner face.

8. Positive-displacement rotary pump comprising a pair of meshing gears defining a driving gear and a driven gear, which are contained in a shell having an output opening and an intake opening for a fluid, the gears having shafts which are supported by bushings having two faces subjected, to pressures which bring about an axial load (S', S") on the bushing itself, wherein the resultant of the axial loads (S', S") on the two bushings has a predetermined direction so as to move the bushings and the gears as a whole into close abutment with a predetermined reference plane, and wherein depressions or localized channels are provided on one of the two faces of at least one of the bushings in order to allow the hydrodynamic lubrication thereof.

9. Positive-displacement pump according to claim 8, wherein the depressions or channels extend radially over the face of the bushing, the profile-section of each depression being slightly concave in the direction orthogonal to the radius, a slightly deeper slot or channel being provided in a substantially central zone of each depression.

* * * * *